United States Patent [19]

Bourdon

[11] 3,938,874

[45] Feb. 17, 1976

[54] ELECTRICAL CONNECTOR CONTACT RETENTION SYSTEM

[75] Inventor: Normand C. Bourdon, Sidney, N.Y.

[73] Assignee: The Bendix Corporation, Southfield, Mich.

[22] Filed: Apr. 17, 1975

[21] Appl. No.: 569,028

Related U.S. Application Data

[63] Continuation of Ser. No. 433,965, Jan. 16, 1974, abandoned.

[52] U.S. Cl. ..... 339/59 M; 339/217 S

[51] Int. Cl.[2] ..... H01R 13/42

[58] Field of Search ... 339/59 R, 59 M, 60 R, 60 C, 339/60 M, 61 R, 61 M, 217 R, 217 S

[56] References Cited

UNITED STATES PATENTS

| | | | |
|---|---|---|---|
| 3,165,369 | 1/1965 | Maston | 339/59 M |
| 3,571,784 | 3/1971 | Naus | 339/217 S |
| 3,634,811 | 1/1972 | Teagno et al. | 339/217 S X |
| 3,727,172 | 4/1973 | Clark | 339/59 M |
| 3,808,590 | 4/1974 | Hemmer et al. | 339/217 S |

*Primary Examiner*—Joseph H. McGlynn
*Assistant Examiner*—Howard N. Goldberg
*Attorney, Agent, or Firm*—Raymond J. Eifler

[57] ABSTRACT

An electrical connector that includes an assembly for demountably mounting the electrical contacts within a connector body. The contact retention system includes an insert (30) that includes a plurality of generally rectangularly shaped retention members (31) that provide for lateral support of a contact (10) in addition to preventing rearward movement of the contact once it is completely inserted into the insert (30). The retention members are resiliently expandable in a radial direction so that the contact retention members will expand to allow the enlarged portion of the contact to pass through the insert but contract behind the enlarged portion of the contact to prevent rearward movement thereof.

6 Claims, 4 Drawing Figures

FIG. 1
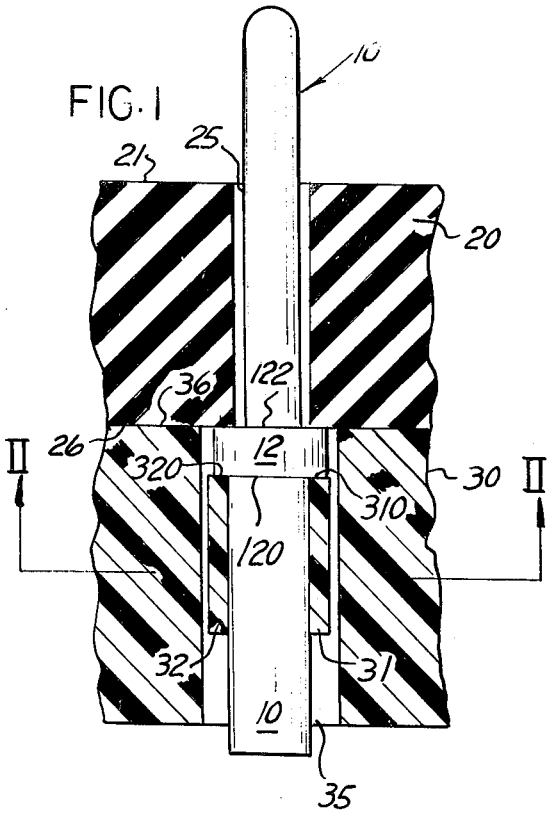
FIG. 2
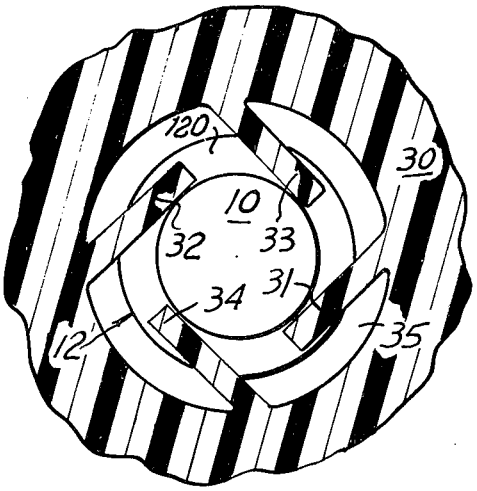
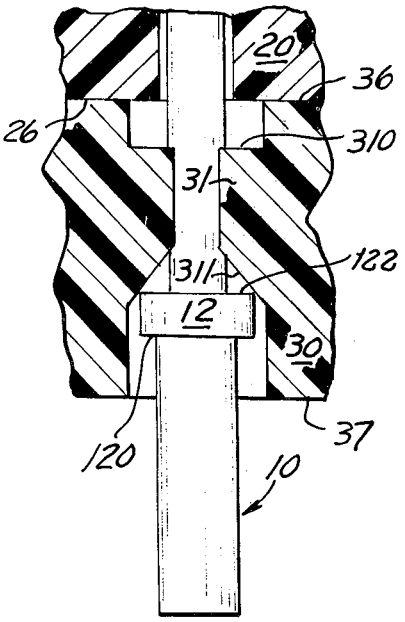
FIG. 4
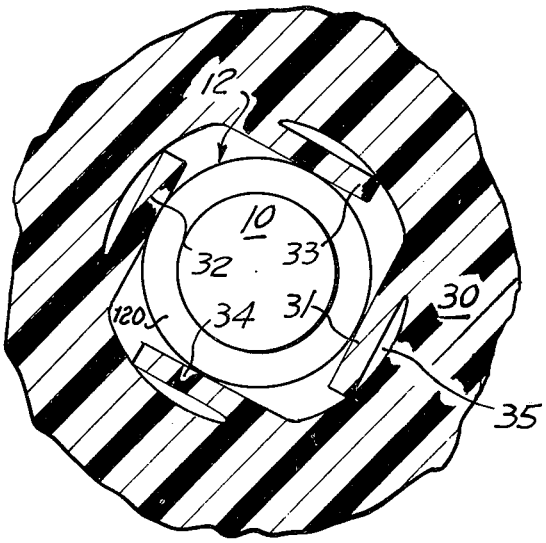
FIG. 3

ELECTRICAL CONNECTOR CONTACT RETENTION SYSTEM

CROSS REFERENCE TO RELATED APPLICATIONS

This is a continuation of application Ser. No. 433,965 filed Jan. 16, 1974, now abandoned.

BACKGROUND OF THE INVENTION

This invention relates to electrical connectors of the type having a plurality of contacts in one connector member which are mateable with a plurality of contacts in another connector member when the members are inter-engaged. This invention is more particularly related to a retention mechanism in the connector members which permits the contacts to be snapped into their operative position in respective bores in the insulators of the connector members and also permits the contacts to be released for withdrawal from the respective bores by use of a suitable release tool.

Various systems have been employed in the electrical connector art for snap-in retention of the contacts in the insulation bodies of the connector members. Some systems of this general type utilize individual spring retention clips or rings which circumscribe the respective contact members and are either mounted on the contacts for engagement against respective shoulders in the insulator bores or mounted in the bores for engagement against the respective shoulders on the contacts. Two examples of such retention mechanisms may be found in U.S. Pat. No. 3,366,921 entitled "Electrical Connector," issued Jan. 30, 1968 to P. C. Culver; and U.S. Pat. No. 3,158,424 entitled "Contact Mounting", issued Nov. 24, 1964 to R. Bowen.

In electrical connector assemblies where it is not necessary to have individual contact retention mechanisms, the individual contact retention mechanisms may be assembled into a single assembly which demountably retains a plurality of electrical contacts, each of which is independently releasable. One example of a single assembly that demountably retains electrical contacts may be found in U.S. Pat. No. 3,165,369 entitled "Retention Systems for Electrical Contacts", issued Jan. 12, 1965 to J. W. Maston. A particular disadvantage associated with this design is that it is characterized by a plurality of tower configurations that extend above the surface of the inset and, because of the material which they were comprised of, and their exposed position, are subject to damage during handling. Obviously, damage to one of the insert retention towers made it necessary to discard the entire assembly since the retention towers were an integral part of the retention assembly.

Subsequent improvements to the foregoing types of contact retention mechanisms involve moving the integral contact retention fingers from the outside surface of an insert to the internal portions of the insert by placing them within the passages in the insert which receive the contacts. One example of this type of contact retention mechanism may be found in U.S. Pat. No. 3,727,172 entitled "Electrical Connector" issued Apr. 10, 1973 to K. M. Clark.

A significant problem associated with all the aforementioned contact retention mechanisms is that the retention fingers which prevent rearward movement of the contact must be resilient enough to expand, yet rigid enough to prevent rearward movement of the contact against forces normally operating on the contact. It has been pointed out that a severe problem arises in making integral plastic fingers strong enough to resist the rearward forces imposed on the contact without buckling and breaking. The retention fingers are loaded as columns, and, because their outer ends are free from engagement with a contact shoulder, they ordinarily lack stability. This, in turn, reduces the loading that they can withstand before buckling. Also, retention fingers of conventional configuration are loaded eccentrically to their neutral column centers, increasing the tendency to buckle under load. The relatively thin fingers additionally are subject to possible failure in shear, or may break from an inability to flex properly. The most recent approach to solving this problem is disclosed in the aforementioned Clark patent wherein the forward ends of the fingers are made thicker than the bases of the fingers and are provided with radial edges to engage the contact shoulders. The finger ends also include inner surfaces that are cylindrical segments to complementarily engage the barrel of a contact, the thinner base portions of the fingers providing the flexibility to allow contact insertions but also providing a weak point in the retention finger.

Accordingly, the problem with existing electrical connector contact retention assemblies is that the retention fingers used therein are subject to forces which adversely affect or cause failure of the retention fingers.

SUMMARY OF THE INVENTION

This invention provides an alternate approach to existing contact retention assemblies by providing contact retention members integral with the contact returning insert that have a shape and arrangement that distributes the forces applied thereto by a contact in a manner that prevents failure or adverse stress and strain on the retention fingers.

The invention is an electrical connector characterized by a contact retaining mechanism that includes a plurality of generally rectangularly shaped contact retaining members 31 that are an integral part of the contact retaining insert. The arrangement of the retention members within the connector insert passage provides an improved means for preventing rearward movement of an electrical contact inserted into the passage as well as providing longitudinal support to the contact which inhibits radial movement of the contact during normal use or handling.

In one embodiment of the invention, an electrical connector unit incorporating the principle of the invention comprises: a first insulator 20 having a plurality of bores 25 therethrough extending from a forward face 21 to a rearward face 26, each of said bores 25 having a central axis; and a second insulator having a front face 36 mounted against the rearward face 26 of the first insulator 20, said second insulator 30 having a plurality of passages 35 therethrough, each axially aligned with the central axis of a respective bore 25 in said first insulator 20, each of said bores 25 and passages 35 adapted to receive an electrical contact 10, which is insertable from the rear of said second insulator 30, each of said contacts 10 having an enlarged section 12 defining a rearwardly facing shoulder 120 and a forwardly facing shoulder 122, said second insulator 30 further including: a plurality of rectangularly shaped contact retention members 31–34 disposed in each of said passages 35, said members 31–34 having a front end, a rear end 311 and an adjacent side between said front and rear ends which is integral with said second insulator 30 so that said retention members 31–34 extend from the walls of said second insulator passages 35, each of said rear ends 311 tapering inwardly from the wall of said passage toward said central axis in the direction of said first insulator 20, each of said forward ends including a forwardly facing surface 310 which is integral at one end with the passage wall, each of the forwardly facing surfaces 310, 320 being equally distant from the front face 36 of said second insulator 30, each of said retention members 31–34 being resiliently expandable away from said central axis to permit the enlarged contact section 12 to pass into said passage and past the retention members 31–34 upon forward insertion of the contact into the passage and respective bore from the rear of the second insulator 30, the retention members 31–34 contracting behind the rearwardly facing shoulder 120 on the contact 10 upon insertion so that the forwardly facing surfaces 310, 320 of the retention members 31–34 engage the rearwardly facing shoulder 120 of contact 10 to limit rearward movement of the contact in the passage 35, the contact retention members being substantially rigid in the axial direction when in their contracted position behind the enlarged portion of the contact so as to provide a positive stop against rearward movement of the respective contact.

Accordingly, it is an object of this invention to provide a new and improved approach to prior art contact mounting systems.

It is another object of this invention to provide contact retaining members that provide lateral support for a retained contact so as to inhibit radial movement of a contact.

It is also an object of this invention to provide contact retaining fingers that have a configuration which improves their contact retaining function.

It is a further object of this invention to provide contact retaining fingers that have a configuration that reduces the stress and/or strain applied to such fingers during use.

It is a further object of this invention to provide an improved electrical connector.

It is still a further object of this invention to provide a contact mounting assembly which allows for individual removal of contacts mounted therein. In this connection, the invention contemplates that a suitable tool, such as a blade or semi-circular sleeve, may be inserted to depress the resilient retention members away from its locking position with the contact and thus enable the contact terminal to be manually withdrawn from the rear of the insulator without access to or engagement of any part of the forward end of the terminal or face of the insulation bar.

The above and other objects and features of the invention will become apparent from the following detailed description taken in conjunction with the accompanying drawings and claims which form a part of this specification.

BRIEF DESCRIPTION OF THE DRAWINGS

FIG. 1 is a partial cross-sectional view of an electrical connector that illustrates the contact retention members in their contact retaining position.

FIG. 2 is a cross-sectional view of the contact retaining members taken along lines II—II of FIG. 1.

FIG. 3 is a diagrammatic view which illustrates the shape of the contact retaining members, with an electrical contact located in a partially inserted position before the retention members have been deflected.

FIG. 4 is a partial cross-sectional view which illustrates the position of the contact retention members when the enlarged portion of an electrical contact has deflected the retention members.

DETAILED DESCRIPTION OF THE DRAWINGS

FIG. 1 is a partial cross-sectional view of an electrical connector wherein a contact 10 is located in the fully inserted position with the contact retention members 31, 32 contracted behind the shoulder 120 of the contact 10 to prevent rearward movement of the contact. The electrical connector unit shown in FIG. 1 includes a forward insulator 20; a rear insulator 30, that includes an integral part thereof contact retention members 31, 32; and a contact 10 retained by the insulators 20 and 30.

The forward insulator 20 includes a forward face 21, a rear face 26, and a plurality of bores 25 which extend between the front face 21 and a rear face 26, each of the bores 25 in the insert 20 having a generally cylindrical configuration for receiving the contact member 10 and having a central axis.

The rear insulator 30 includes a forward face 36; a cylindrical passage 35 axially aligned with the central axis of a respective bore 25; and a plurality of rectangularly shaped retention members 31, 32 extending from the wall of the passage 35. Each of the rectangularly shaped retention members 31, 32 include a forwardly facing surface 310, 320 which are equally distant from the faces 36 of the insert 30. The front portions 310, 320 of the retention members 31, 32 provide internal forwardly facing shoulders. Each of the retention members are resiliently deflectable in the direction away from the central axis. Although the passage 35 is illustrated as having a uniform diameter, the diameter of the passage 35 may be increased or decreased to obtain different advantages. For example, the diameter of the passage 35 along that portion that includes retention members 31, 32 may be enlarged so that the thickness of the retention members 31, 32 may be increased and sufficient clearance provided to allow the retention members to be deflected in the direction away from the central axis, thereby allowing the large portion 12 of the electrical contact 10 to pass by the retention members in the forward direction.

The contact 10 is a male pin-type electrical contact that includes an enlarged portion 12 that has a forwardly facing shoulder 122, a rearwardly facing shoulder 120 and a peripheral portion 121. When the contact 10 is in the fully inserted position as shown, the forwardly facing surfaces 310, 320 of the retention members 31, 32 engage the rearwardly facing shoulder 120 of the contact 10 to prevent rearward movement of the electrical contact 10. Forward movement of the electrical contact 10 is prevented by engagement of the forwardly facing contact shoulder 122 which engages the rearward face 26 of the forward insert 20.

FIG. 2 is a cross-sectional view of the contact retaining members taken along lines II—II of FIG. 1. FIG. 2 illustrates how each of the contact retaining members 31, 32, 33, 34 are arranged behind the enlarged portion 12 of the electrical contact 10 to prevent rearward movement thereof.

Each of the contact retaining members 31, 32, 33, 34 are an integral part of the insulator 30 and are resiliently deflectable in the radial direction to allow the enlarged portion 12 of the contact 10 to pass into the passage 35 when the contact 10 is inserted in the passage from the rear of the passage. Although two retention members may be joined to the insulator 30 at a common point, it is preferred that each of the retention members 31, 32, 33, 34 be integral with the insulator 30 at different points so as to better distribute shear forces acting upon the members 31, 32, 33, 34 may radially deflect sufficiently to allow the passage of the enlarged portion 12 of the contact 10 through the passage 35.

FIG. 3 is a diagrammatic view used to illustrate the configuration of the retention members. Each retention member 31 has a rear end portion 311 that is tapered inwardly from the wall of the passage towards the central axis in the direction of the first insulator 20 and a front portion that includes the forwardly facing surface 310, one end of which is integral with the wall of the passage 35. This configuration is substantially different from prior art retention members which terminate in a free end that contracts behind a contact shoulder 120 to retain the contact 10. The inventor believes that this configuration of a retention member is not as subject to buckling as a result of rearwardly applied force as are the retention fingers described in the aforementioned patents which incline inwardly and forwardly with respect to the central axis. The configuration shown in FIG. 3 allows the enlarged portion 12 of a contact 10 to expand the contact retention member 31 away from the central axis when the contact 10 is inserted into the passage 35 towards the forward insert 20. FIG. 3 also illustrates the fact that the retention member 31 will be subject substantially only to shear when a contact 10 is retained and a rearward force applied to a contact.

FIG. 4 is a partial cross-sectional view which illustrates the position of the contact retention members 31, 32, 33, 34 when enlarged portion 12 of the electrical contact 10 has deflected the retention members 31, 32, 33, 34.

While a preferred embodiment of the invention has been disclosed, it will become apparent to those skilled in the art that changes may be made in the invention as set forth in the appended claims and, in some instances, certain features of the invention may be used to advantage without corresponding use of other features. Accordingly, it is intended that the illustrative and descriptive materials herein be used to illustrate the principles of the invention and not to limit the scope thereof.

Having described the invention, what is claimed is:

1. An electrical connector unit comprising:

a first insulator having a plurality of bores therethrough extending from a forward face to a rearward face, each of said bores having a central axis; and a second insulator having a front face mounted against the rearward face of the first insulator, said second insulator having a plurality of passages therethrough, each axially aligned with the central axis of a respective bore in said first insulator, each of said bores and passages adapted to receive an electrical contact, which is insertable from the rear of said second insulator, each of said contacts having an enlarged section defining a rearwardly facing shoulder and a forwardly facing shoulder, said second insulator further including:

a plurality of rectangularly shaped contact retention members disposed in each of said passages, said members having a front end, a rear end, and an adjacent side between front and rear ends which is integral with said second insulator so that said retention members extend from the walls of said second insulator passages, each of said rear ends tapering inwardly from the wall of said passage towards said central axis in the direction of said first insulator, each of said forward ends including a forwardly facing surface which faces in the direction of said first insulator, said forwardly facing surface being generally parallel to the front face of said second insulator and integral with said passage wall at the end furthest from the axis of said passage, each of said forwardly facing surfaces being equally distant from said second insulator front face, each of said retention members being resiliently expandable away from said central axis to permit said enlarged contact section to pass into said passage and past said retention members upon forward insertion of the contact into said passage and respective bore from the rear of said second insulator, said retention members contracting behind the rearwardly facing shoulder on the contact upon insertion so that the forwardly facing surfaces of said retention members engage the rearwardly facing shoulder of the contact to limit rearward movement of the contact in said passage, said contact retention members being substantially rigid in the axial direction when in their contracted position behind the enlarged portion of the contact so as to provide a positive stop against rearward movement of the respective contact.

2. The electrical connector unit recited in claim 1 wherein the plurality of contact retention members comprises four retention members, each of said retention members forwardly facing surfaces having a substantially uniform cross-sectional area, each of said retention members being perpendicular to at least one other member so as to provide a generally square shaped opening adapted to receive that portion of said contact which extends rearwardly from the rearwardly facing shoulder of the contact.

3. The electrical connector unit as recited in claim 1 wherein each of the bores in said first insulator are sized so that the enlarged portion of a contact cannot pass through said bore, whereby said first insulator provides means for stopping the forward movement of a contact inserted into said bore.

4. The electrical connector unit as recited in claim 2 wherein each of the bores in said first insulator are sized so that the enlarged portion of a contact cannot pass through said bore, whereby said first insulator provides means for stopping the forward movement of a contact inserted into said bore.

5. In the combination of an electrical connector of the type having a plurality of electrical contacts retained by an insert, the improvement wherein the insert comprises:

an insulator having a front face, a rear face, and a plurality of passages therethrough extending from the front face to the rear face, each of said passages having a central axis, each of said passages adapted to receive a respective electrical contact which is insertable from the rear of said insulator, each contact having an enlarged section defining a rearwardly facing shoulder; and a plurality of contact retention members disposed in each of said passages, each of said retention members integral with said insulator and including a forward portion and a rearward portion, each of said rear portions tapering from the wall of said passage inwardly towards the central axis in the direction of said insulator front face, each of said forward portions of said retention members including a forward facing surface which faces in the direction of the front face of said insulator, said forward facing surface being generally parallel to the front face of said insulator and integral with said passage wall at the end furthest from the central axis of said insulator, each of said forward facing surfaces being equally distant from said insulator front face, each of said retention members being resiliently expandable away from said central axis to permit said enlarged contact section to pass into said passage and past said retention members upon forward insertion of the contact into the passage from the rear of said insulator, said retention members contracting behind the rearwardly facing shoulder on the contact so that each of the forward facing surfaces of said retention members engage the rearward facing shoulder on the contact to limit rearward movement of the contact in said passage, said contact retention members being substantially rigid in the axial direction when in their contracted position behind the enlarged portion of the contact so as to provide a positive stop against rearward movement of the respective contact.

6. The electrical connector unit recited in claim 5 wherein the plurality of contact retention members comprises four retention members, each of the forwardly facing surfaces of said retention members having a substantially uniform cross-sectional area, each of said retention members being perpendicular to at least the other member so as to provide a generally square shaped opening adapted to receive that portion of said contact which extends rearwardly from the rearwardly facing shoulder of the contact.

* * * * *